US010180699B1

(12) United States Patent
Love et al.

(10) Patent No.: US 10,180,699 B1
(45) Date of Patent: Jan. 15, 2019

(54) SYSTEM, APPARATUS AND METHOD FOR PEDAL CONTROL

(71) Applicant: The United States of America as represented by the Administrator of the National Aeronautics and Space Administration, Washington, DC (US)

(72) Inventors: Stanley G. Love, Houston, TX (US); Lee M. Morin, Friendswood, TX (US); Mary E. McCabe, Pearland, TX (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 709 days.

(21) Appl. No.: 14/446,511

(22) Filed: Jul. 30, 2014

Related U.S. Application Data

(60) Provisional application No. 61/863,691, filed on Aug. 8, 2013.

(51) Int. Cl.
*G05G 11/00* (2006.01)
*G05G 1/44* (2008.04)

(52) U.S. Cl.
CPC ..... *G05G 11/00* (2013.01); *G05G 1/44* (2013.01)

(58) Field of Classification Search
CPC ..... G05G 11/00; G05G 1/44
See application file for complete search history.

(56) References Cited

U.S. PATENT DOCUMENTS

| | | | | |
|---|---|---|---|---|
| 1,998,677 | A | 4/1935 | Isaac et al. | |
| 2,585,688 | A | 2/1952 | Saulnier | |
| 3,377,881 | A | 3/1968 | Lucas | |
| 3,576,302 | A | 4/1971 | Palfreymen | |
| 2,424,523 | A | 7/1974 | Watter | |
| 4,470,570 | A | 9/1984 | Sakurai et al. | |
| 4,848,708 | A | 7/1989 | Farrell et al. | |
| 5,121,889 | A * | 6/1992 | Carey, Jr. | B64C 13/04 114/144 R |
| 5,170,969 | A | 12/1992 | Lin | |

(Continued)

OTHER PUBLICATIONS

Goza et al., Telepresence Control of the NASA/DARPA Robonaut on a Mobility Platform; CHI 2004, , Apr. 2004, pp. 623-629, vol. 6, No. 1.

*Primary Examiner* — Kenneth M Lo
*Assistant Examiner* — David J Wynne
(74) *Attorney, Agent, or Firm* — Kurt G Hammerle; Edward K. Fein; Mark P. Dvorscak

(57) ABSTRACT

An apparatus, method, and system for controlling motion in six degrees of freedom is described. The apparatus includes a support structure, a first pedal and a second pedal. A first set of three independent articulating mechanisms is operatively connected to the support structure and the first pedal. The first set of three independent articulating mechanisms, in combination, enable motion of the first pedal in three control axes corresponding to three discrete degrees of freedom. A second set of three independent articulating mechanisms, operatively connected to the second pedal, enable motion, in combination, in three control axes corresponding to a discrete second set of three degrees of freedom. The apparatus may also include first and second sensors configured to detect the motion of the first and second pedals.

12 Claims, 10 Drawing Sheets

(56) References Cited

U.S. PATENT DOCUMENTS

| | | | | |
|---|---|---|---|---|
| 5,583,407 | A | 12/1996 | Yamaguchi | |
| 5,725,184 | A | 3/1998 | Kang et al. | |
| 5,791,596 | A | 8/1998 | Gautier et al. | |
| 6,115,639 | A * | 9/2000 | Takenaka | B25J 9/1689 318/568.12 |
| 7,590,604 | B2 | 9/2009 | Geoghegan | |
| 7,644,893 | B2 | 1/2010 | Boczar et al. | |
| 7,726,611 | B2 | 6/2010 | Christensen et al. | |
| 8,353,484 | B2 | 1/2013 | Gardner et al. | |
| 2008/0197239 | A1 | 8/2008 | Bellouard et al. | |
| 2010/0044500 | A1 | 2/2010 | Oyama et al. | |
| 2010/0060614 | A1 * | 3/2010 | Enns | A63F 13/06 345/184 |
| 2012/0304806 | A1 * | 12/2012 | Dumitrescu | B60K 26/02 74/561 |

* cited by examiner

SYSTEM, APPARATUS AND METHOD FOR PEDAL CONTROL

CROSS-REFERENCE TO RELATED APPLICATIONS

This application claims priority to U.S. Provisional Application Ser. No. 61/863,691 filed on Aug. 8, 2013, entitled "System, Apparatus, and Method for Pedal Control."

ORIGIN OF INVENTION

The invention described herein was made by employee(s) of the United States Government and may be manufactured and used by or for the Government of the United States of America for governmental purposes without the payment of any royalties thereon or therefor.

FIELD OF DISCLOSURE

Embodiments disclosed herein generally relate to systems, methods and apparatus for controlling movement of an object in six degrees of freedom using two pedals.

SUMMARY

In one aspect, embodiments disclosed herein relate to an apparatus for controlling motion in six degrees of freedom. The apparatus includes a support or support structure to position the apparatus, such as placement upon a surface, a first pedal, a second pedal, a first set of independent articulating mechanisms or members operatively connected to the support and the first pedal, and a second set of independent articulating mechanisms or members operatively connected to the support and the second pedal. Each independent articulating mechanism of the first set is configured to enable discrete motion in a control axis corresponding to a one of three translational degrees of freedom. Further, the first set of three independent articulating mechanisms is configured, in combination, to enable motion of the first pedal in all three translational degrees of freedom. Each independent articulating mechanism of the second set is configured to enable discrete motion in a control axis corresponding to a one of three rotational degrees of freedom. Further, the second set of three independent articulating mechanisms is configured, in combination, to enable motion of the second pedal in all three rotational degrees of freedom. In another embodiment, a first sensor is configured to detect the motion of the first set of independent articulating mechanisms and/or the motion of the first pedal, and a second sensor is configured to detect the motion of the second set of independent articulating mechanisms and/or the motion of the second pedal.

In another aspect, embodiments disclosed herein relate to a method for pedal control of an object in six degrees of freedom. The method includes measuring positional motion of a first pedal and positional motion of a second pedal of a pedal control assembly, converting the measured positional motion of the first pedal into a first set of data, converting the measured positional motion of the second pedal into a second set of data, communicating the first set of data and the second set of a data to a computing device, and converting the first set of data and the second set of data into a set of instructions for control of the object in six degrees of freedom.

In another aspect, embodiments described herein relate to a system to control motion of an object in six degrees of freedom. The system comprises: (a) a housing for electronics; (b) a pedal assembly operatively connected to the housing, the pedal assembly comprising: (1) a support; (2) a first pedal and a second pedal; (3) a first set of three independent articulating mechanisms or members operatively connected to the first pedal and to the support, each independent articulating mechanism of the first set configured to enable discrete motion in a control axis corresponding to one of three translational degrees of freedom and three rotational degrees of freedom, the first set of three independent articulating mechanisms, in combination, configured to enable motion of the first pedal in a total of three degrees of freedom; and (4) a second set of three independent articulating mechanisms or members operatively connected to the second pedal and to the support, each independent articulating mechanism of the second set configured to enable discrete motion in a control axis corresponding to one of three translational degrees of freedom and three rotational degrees of freedom, the second set of three independent articulating mechanisms, in combination, configured to enable motion of the second pedal in a total of three degrees of freedom; (c) a motion tracking system for acquiring data responsive to the motion of the first pedal and to motion of the second pedal by measuring motion of each pedal independently from a neutral centering position; and (d) a subsystem of electronics for receiving data acquired by the motion tracking system, the subsystem of electronics including a central processing unit (CPU) and a memory for storing instructions that, when executed, cause the subsystem to convert the data acquired by the motion tracking system into a second set of instructions for control of the object, wherein discrete motion of a foot of an operator in a control axis is mapped into a set of instructions that is correspondingly intuitive to movement of the object in one of the six degrees of freedom.

Other aspects will be apparent from the following description and the appended claims.

DETAILED DESCRIPTION

Figure 1:
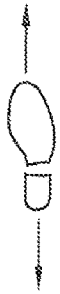
FIG. 1 shows a schematic of a foot movement in accordance with one or more embodiments described herein.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description.

In one aspect, embodiments disclosed herein generally relate to pedal control of six degrees of freedom of an object. "Six degrees of freedom" refers to the freedom of movement of an object or body in three-dimensional space. In this application, the term six degrees of freedom is used to describe how a rigid body is free to move in a set of three translational directions, for example forward/backward, up/down, left/right (the translation is denoted in three perpendicular axes) combined with three rotational directions, also denoted about three perpendicular axes, which are often named pitch, yaw, and roll.

For example, six degree of freedom movement is the motion of a vessel at sea. The translational motion of a vessel at sea may be described as moving up and down (heaving); moving left and right (swaying); and moving forward and backward (surging). The rotational motion of a vessel at sea may be described as tilting forward and backward (pitching); turning left and right (yawing); and tilting side to side (rolling).

In one or more embodiments, "six degrees of freedom" also refers to virtual movement of an object, such as in an arcade game or simulator. Such an arcade game or simulator may be displayed by a personal computer, or through a gaming console. In these embodiments, the movement of a virtual object may be similar to the six degrees of freedom capable of a rigid body in three-dimensional space, in that movement of the virtual object includes all three translational axes and all three rotational axes.

In another example, a spacecraft has six degrees of freedom: three translational (forward-aft, up-down, port-starboard) and three rotational (pitch, yaw, and roll). Operators or pilots must learn to manage all six different kinds of motion.

Figure 2:
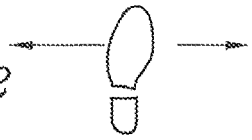
FIG. 2 shows a schematic of a foot movement in accordance with one or more embodiments described herein.

Referring to FIGS. 1-6B, schematics of different foot movements to be translated into commands in accordance with one or more embodiments described herein are shown. FIG. 1 and FIG. 2 show an in-plane translation of the foot in the forward and backward directions (FIG. 1) and in-plane translation of the foot in the left and right directions (FIG. 2). Such in-plane translations of the foot may be performed with both the left or right foot; however, in some embodiments, translation to the right of the left foot or translation to the left of the right foot may be limited or precluded to prevent interference between the pedal assemblies.

Figure 3A:
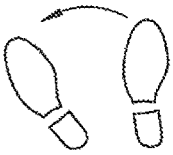
FIGS. 3A and 3B show schematics of foot movements in accordance with one or more embodiments described herein.
Figure 3B:
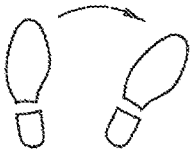

FIG. 3A demonstrates a lateral rotation of the foot to the left, and FIG. 3B demonstrates a lateral rotation of the foot to the right. FIGS. 3A and 3B show rotation to the left/right by an operator essentially pointing his toes to the left (FIG. 3A) or the right (FIG. 3B). The motions in FIGS. 3A and 3B may be made with both the right or left foot, although only the left foot is shown in the drawings.

Figure 4A:
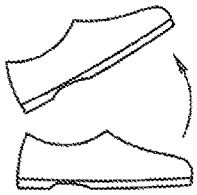
FIGS. 4A and 4B show schematics of foot movements in accordance with one or more embodiments described herein.
Figure 4B:
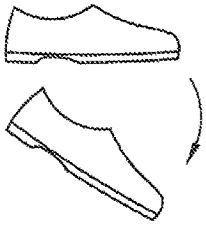

FIG. 4A and FIG. 4B demonstrate rotation of the foot up and down, respectively, by an operator essentially pointing her toes up (FIG. 4A) or down (FIG. 4B). The motions in FIGS. 4A and 4B may be made with both the right or left foot.

Figure 5A:
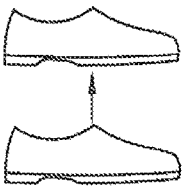
FIGS. 5A and 5B show schematics of foot movements in accordance with one or more embodiments described herein.
Figure 5B:
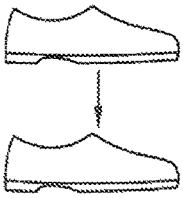

FIGS. 5A and 5B demonstrate translating (moving) the foot up (FIG. 5A) and down (FIG. 5B) in accordance with embodiments disclosed herein. The motion in FIG. 5B is similar to simple depression of a pedal. Note that the motion in FIG. 5B requires the foot to be fixed to the pedal in order to perform the motion. The motions in FIGS. 5A and 5B may be made with both the right or left foot.

Figure 6A:
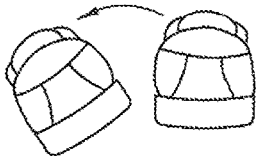
FIGS. 6A and 6B show schematics of foot movements in accordance with one or more embodiments described herein.
Figure 6B:
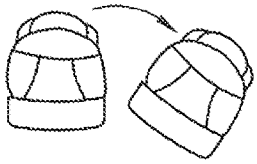

FIG. 6A demonstrates a lateral rolling of the foot to the left, and FIG. 6B demonstrates a lateral rolling of the foot to the right. In some embodiments, the motion demonstrated in FIG. 6A may only be performed by the left foot, while the motion demonstrated in FIG. 6B may only be performed by the right foot, to prevent interference between the pedal assemblies. In addition, the human ankle is not as flexible with respect to lateral rolling to the left by the right foot, and one or more embodiments described herein are designed to facilitate the ease in which an object may be controlled in six degrees of freedom.

Figure 7:
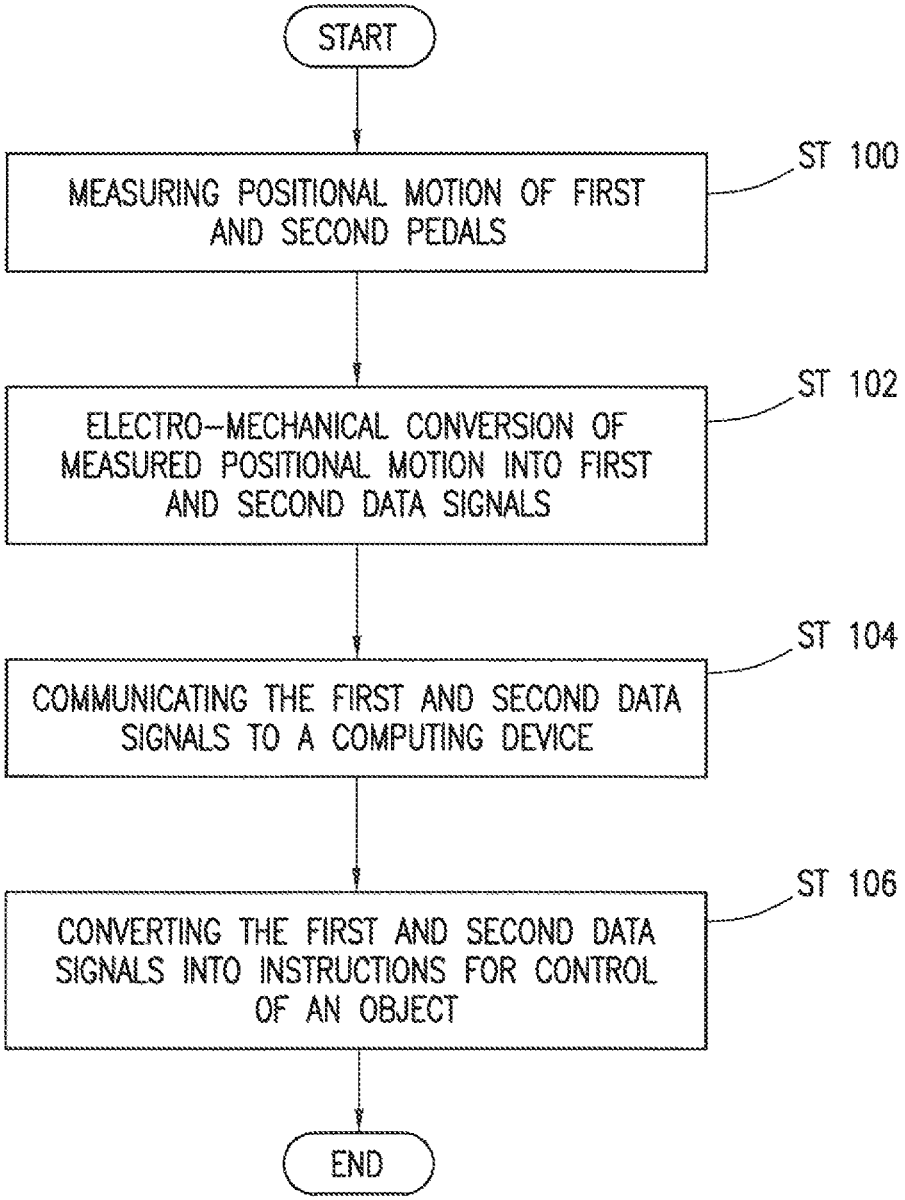
FIG. 7 shows a flow chart of a method in accordance with one or more embodiments described herein.

Embodiments described herein provide control of an object with six degrees of freedom using the motions of the foot such as the exemplary motions described above in FIGS. 1-6B. Referring to FIG. 7, in step ST 100, motions of the foot are measured at the first and second pedal assemblies. The measured positional motion of the first and second pedals is electro-mechanically converted into first data signals and second data signals in step ST 102. In one or more embodiments, the first and second data signals are communicated to a computing device in step ST 104. The computing device converts the first and second data signals into instructions for control of an object with six degrees of freedom in ST 106.

Figure 8:
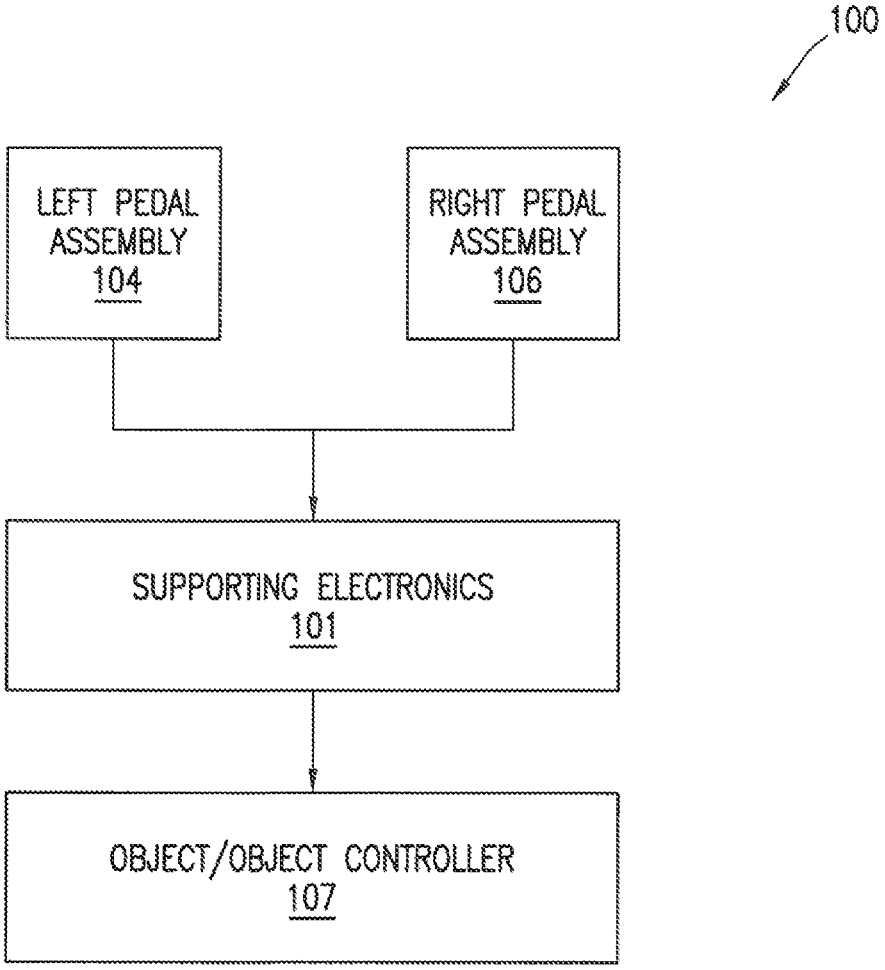
FIG. 8 shows a schematic block diagram in accordance with one or more embodiments described herein.

FIG. 8 is a schematic of a system in accordance with one or more embodiments described herein. Embodiments of the system 100 include a housing for supporting electronics 101, a left pedal assembly 104 and a right pedal assembly 106 for pedal input to the system. The supporting electronics 101 may include a motion sensing system for acquiring the first and second data signals relative to the motion of the right and left pedal assemblies. The supporting electronics 101 may also include a computing device for translating the first and second data signals into instructions to control an object. In one or more embodiments, the supporting electronics 101 is centrally localized with respect to the pedal assemblies. In other embodiments, the supporting electronics 101 may also be integrated into the object to be controlled. The supporting electronics 101 transfers control commands to the object or object controller 107. In some embodiments, the commands are sent to the object 107 that is being controlled, such as, for example, a spacecraft or other vessel. In other embodiments, the commands may be sent to an object controller 107, such as, for example, a game console having a virtually displayed object 107'. The control commands may be sent via electrical or digital signals or converted, for example, to hydraulics, depending on the object being controlled.

Figure 9:
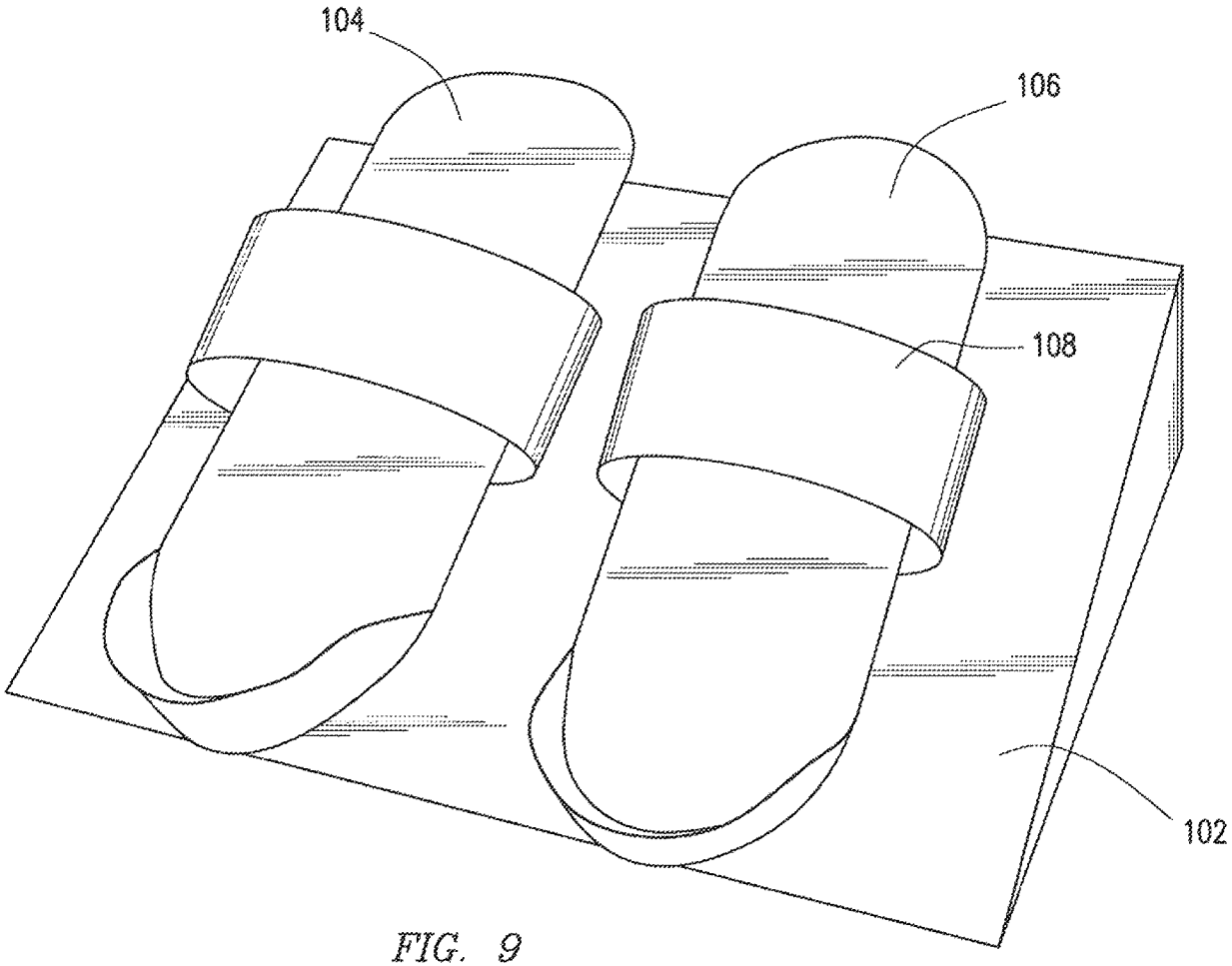
FIG. 9 shows a schematic perspective view in accordance with at least one embodiment described herein.
Figure 10:
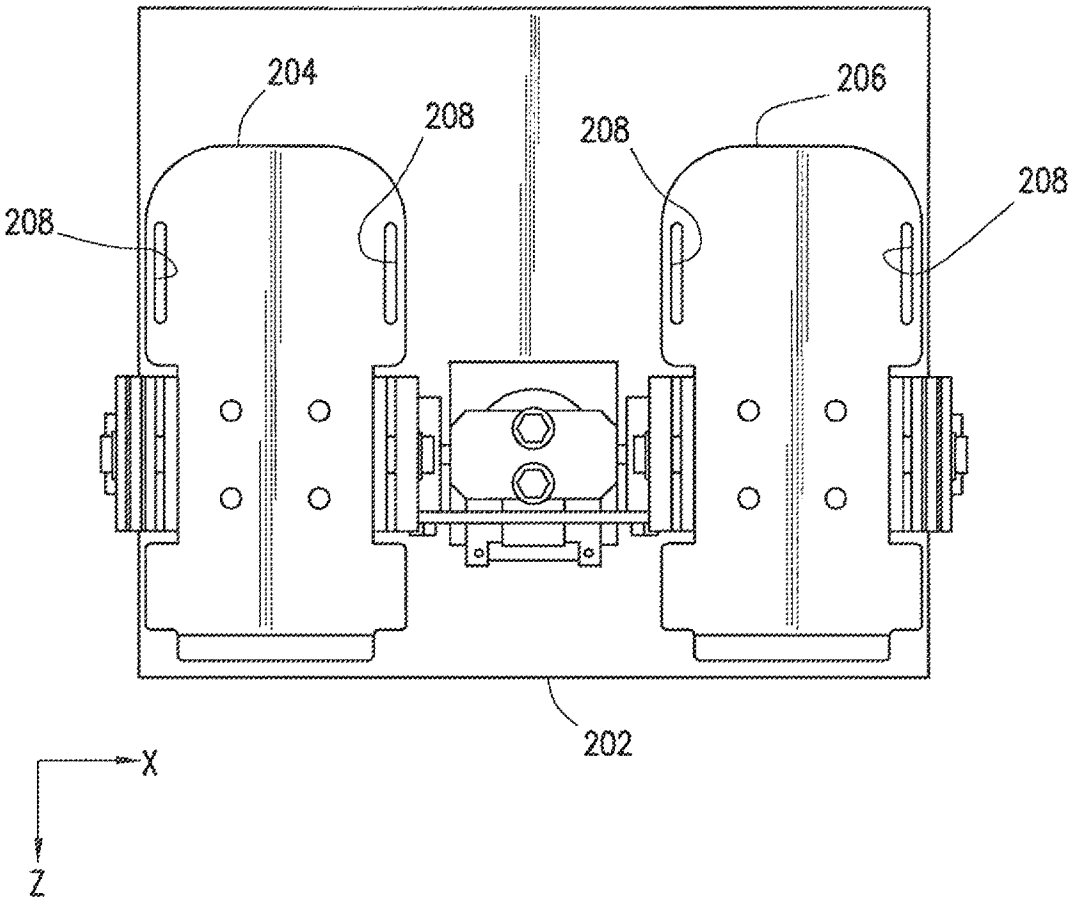
FIG. 10 shows a schematic top view in accordance with one or more embodiments described herein.
Figure 11:
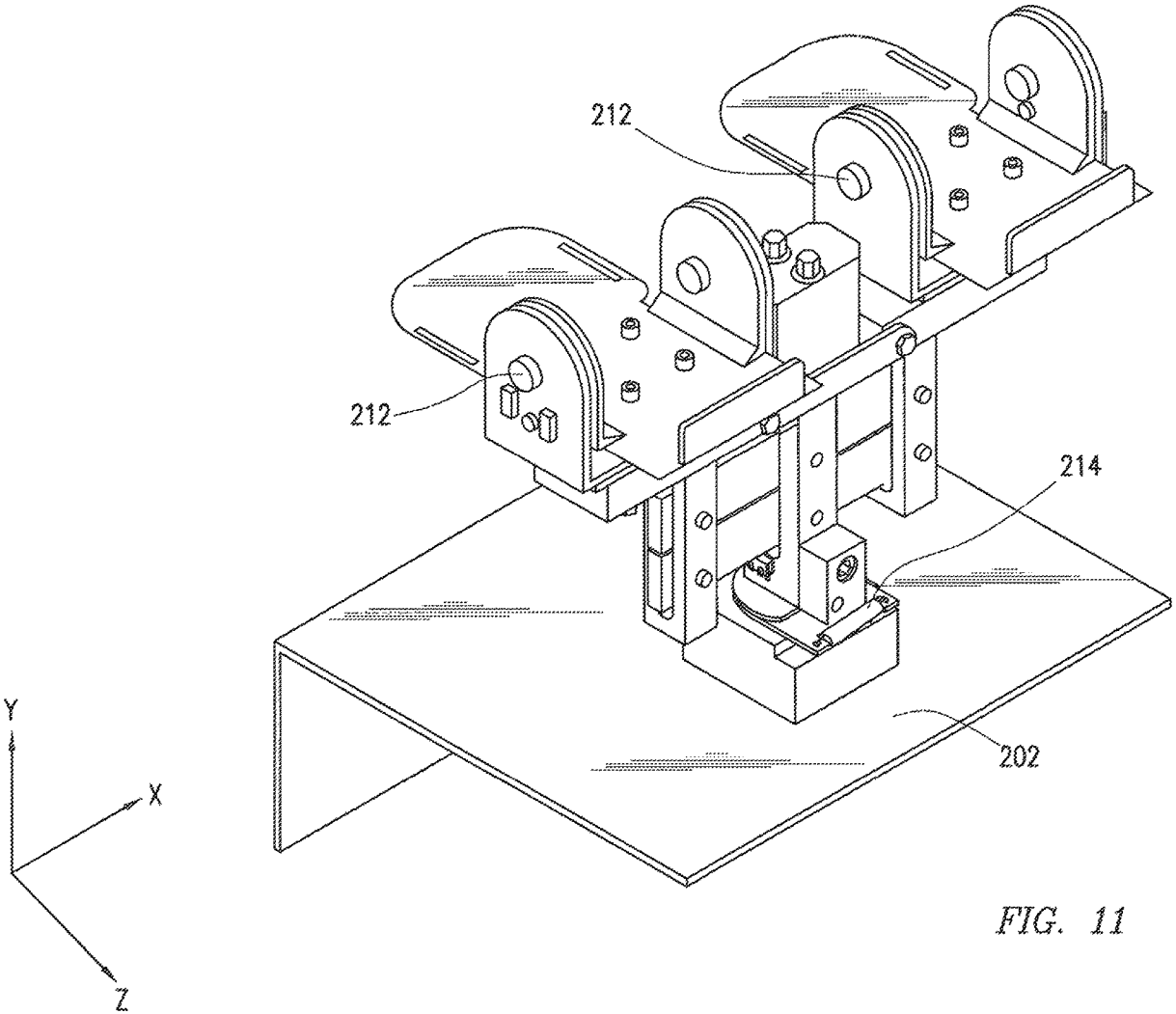
FIG. 11 shows a schematic perspective view in accordance with one or more embodiments described herein.
Figure 12:
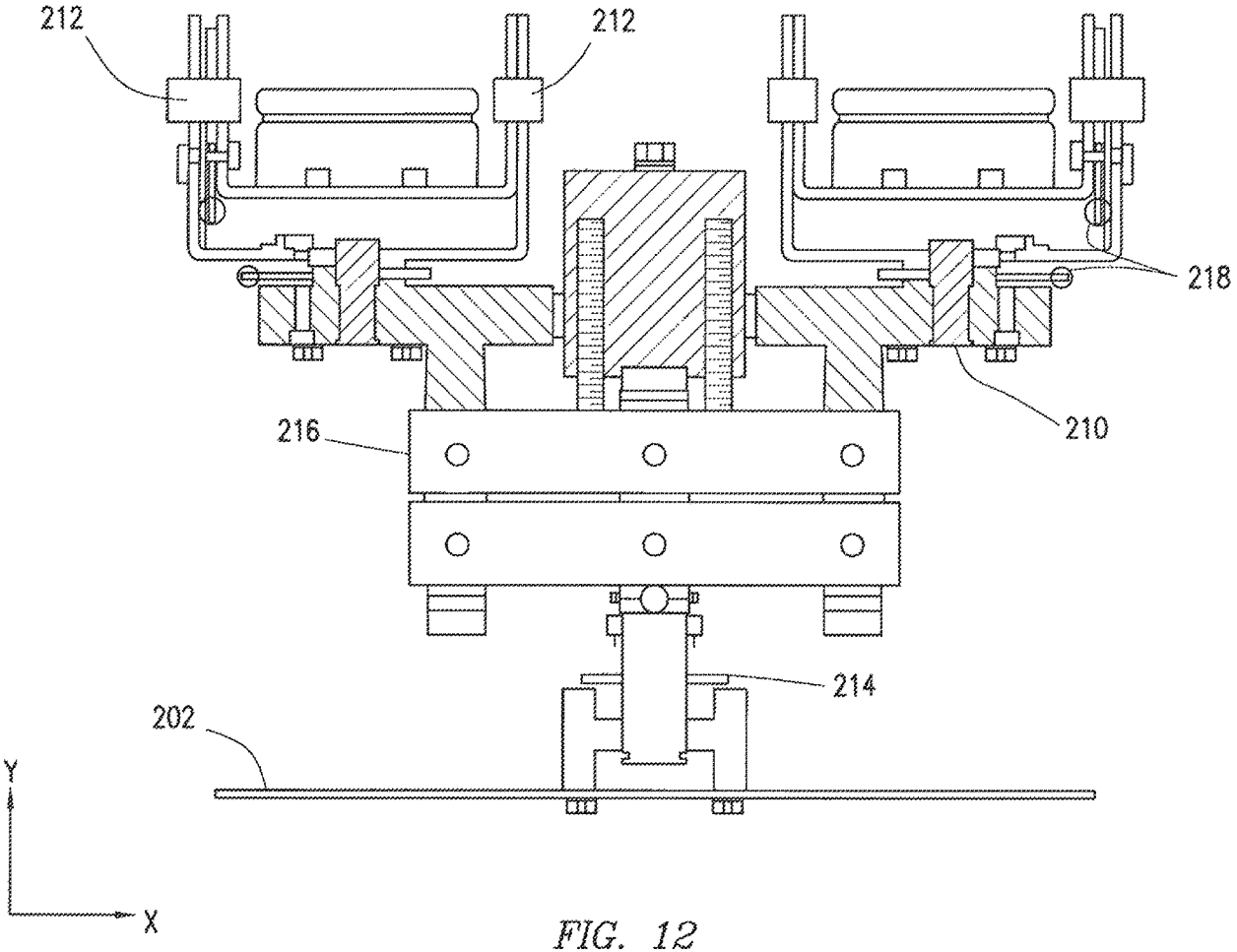
FIG. 12 shows a schematic side view in accordance with one or more embodiments described herein.
Figure 13:
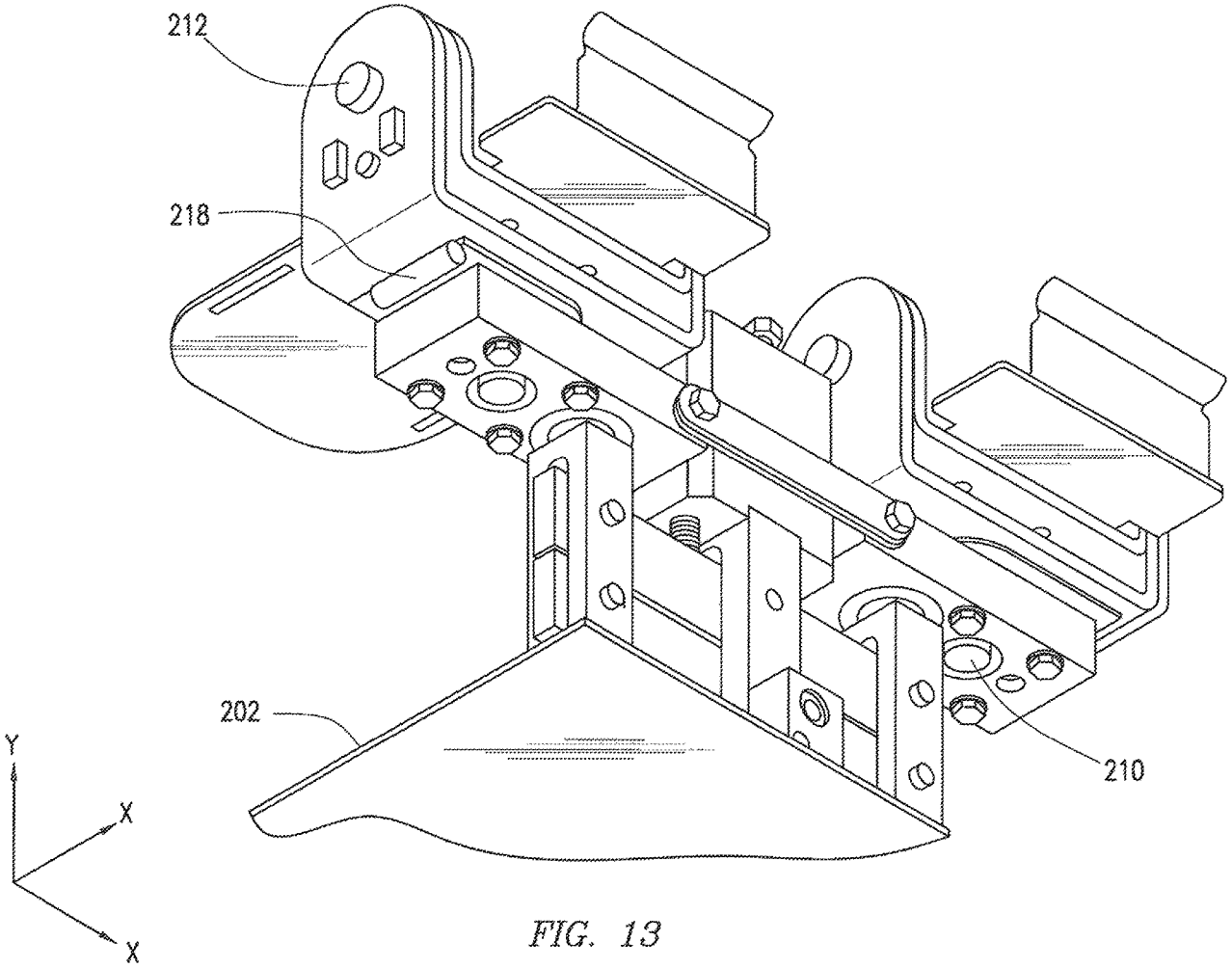
FIG. 13 shows a schematic perspective bottom view in accordance with one or more embodiments described herein.

A schematic perspective view of a basic mechanical structure of an apparatus for pedal control is demonstrated in FIG. 9 in accordance with embodiments described herein.

The basic structure includes a support or housing 102 that includes a left pedal assembly 104 and a right pedal assembly 106. The support 102 may be ergonomically shaped relative to a seat to provide ease of use of the pedals when in use.

The left pedal assembly 104 and the right pedal assembly 106 may include a strap structure 108 to facilitate holding an operator's foot onto the pedal when the pedals are being moved. In other embodiments, the pedal assemblies 104 and 106 may be designed to accommodate a particular shoe that easily attaches or clips into the pedal assemblies 104 and 106 with or without use of strap 108.

In yet other embodiments, a shoe-type structure, such as a sandal or slipper, may be incorporated into the pedal assemblies 104 and 106. Each of the two pedal assemblies 104 and 106 may further comprise a comfortable contoured slipper to accommodate and stabilize the foot of the operator. The slippers may be adjustable or interchangeable for operators of different sizes. Each of the two pedal assemblies is operatively connected to the support structure through independent articulating mechanisms or members which may correspond to different control axes. The shoe-type structure incorporated into the pedal assemblies may be piece-wise adjustable to accommodate operators with different size feet. In another embodiment, a front half and back half of a shoe-type structure may separate so that a user may insert his or her foot, followed by the front half and back half coming together to fit the operator's foot. The adjusting of such a shoe-type structure may be manually performed by the operator, but may also be automatic, for example using a spring mechanism to fit the foot of the operator.

Still referring to FIG. 9, the left pedal assembly 104 and the right pedal assembly 106 are operatively connected to the support 102 in a manner to accommodate and respond to at least one of the motions capable of the foot of an operator, such as one of the motions exemplified and described above with respect to FIGS. 1-6B. As shown in FIG. 9, the pedal assemblies 104 and 106 are operatively connected to or disposed on the support 102 at approximately the middle (i.e., arch) of the bottom (i.e., sole) of the foot; however, pedal assemblies 104 and 106 may also be disposed on the support 102 at another location relative to the eventual position of the foot of the operator. For example, the left pedal assembly 104 and the right pedal assembly 106 may be operatively connected to or disposed on the support 102 at a heel of the foot of the operator.

Referring now to FIGS. 10-15, exemplary schematics of an apparatus and system for pedal control of an object in six degrees of freedom is shown in accordance with one or more embodiments described herein. In one or more embodiments, the apparatus comprises a base support 202, a left pedal assembly 204 having a first set of articulating mechanisms or members (210,212, 214, 216), and a right pedal assembly 206 having a second set of articulating mechanisms or members (210, 212, 214, 216). The support 202 is operatively connected to the left pedal assembly 204 via the first set of articulating mechanisms or members. The support 202 is also operatively connected to the right pedal assembly 206 via the second set of articulating mechanisms or members. The left pedal assembly 204 and right pedal assembly 206 may include attachment slots 208, which are able to accommodate or receive a removable/replaceable strap structure (not shown in FIGS. 10-14 but shown generally in FIGS. 9 and 15 as strap 108) for attaching the foot (or shoe) of the operator to the pedal assembly.

In one or more embodiments, the set of articulating mechanisms correspond or accommodate at least one of the movements of a foot, such as the motions demonstrated in FIGS. 1-6B above. For example, an inward/outward rotation of the foot as demonstrated by FIGS. 3A and 3B may be accommodated by foot articulating mechanism or member 210. Flexion and extension of the foot, such as the motions illustrated by FIGS. 4A and 4B, respectively, may be accommodated by articulating mechanism or member 212. Rotation about a vertical axis of both the left and right pedal assemblies together (i.e., both feet moving together similar to the motions illustrated by FIGS. 3A and 3B) may be provided or accommodated by combined foot pivot articulating mechanism or member 214. Combined foot pivot articulating mechanism or member 214 may also provide for or accommodate in-plane translation of the foot in the forward and backward directions, similar to the motion illustrated in FIG. 1. Elevating the foot up and down, such as the motions illustrated by FIGS. 5A and 5B, respectively, may be accommodated by articulating mechanism or member 216, which is configured to provide antisymmetric elevation and depression of the left and/or right pedal assemblies, i.e., pulling one pedal up and pushing the other pedal down. Other movement of the foot of an operator may also be accommodated by an articulating mechanism or member, such as for example lateral rolling of the foot (foot movement shown in FIGS. 6A and 6B and a representative articulating mechanism or member 110 of FIG. 15); lateral sliding of the foot (foot movement shown in FIG. 2 and a representative articulating mechanism or member 112 of FIG. 15); or forward/backward sliding of the foot (foot movement shown in FIG. 1 and a representative articulating mechanism or member 115 of FIG. 15).

As shown in FIGS. 9-15, in one or more embodiments, the articulating mechanisms or members may be designed to accommodate more than one movement of the foot. For example, in FIG. 15 the articulating mechanisms 110 and 115 may be the same and capable to accommodate both the forward/backward sliding of the foot and the lateral rolling of the foot. However, one of ordinary skill in the art will appreciate, after having the benefit of this disclosure, that the articulating mechanisms are determined based on the ease of operation to control the motion of the object, as well as the ability of the mechanism/member to avoid unintentional commands by the operator.

Figure 14:
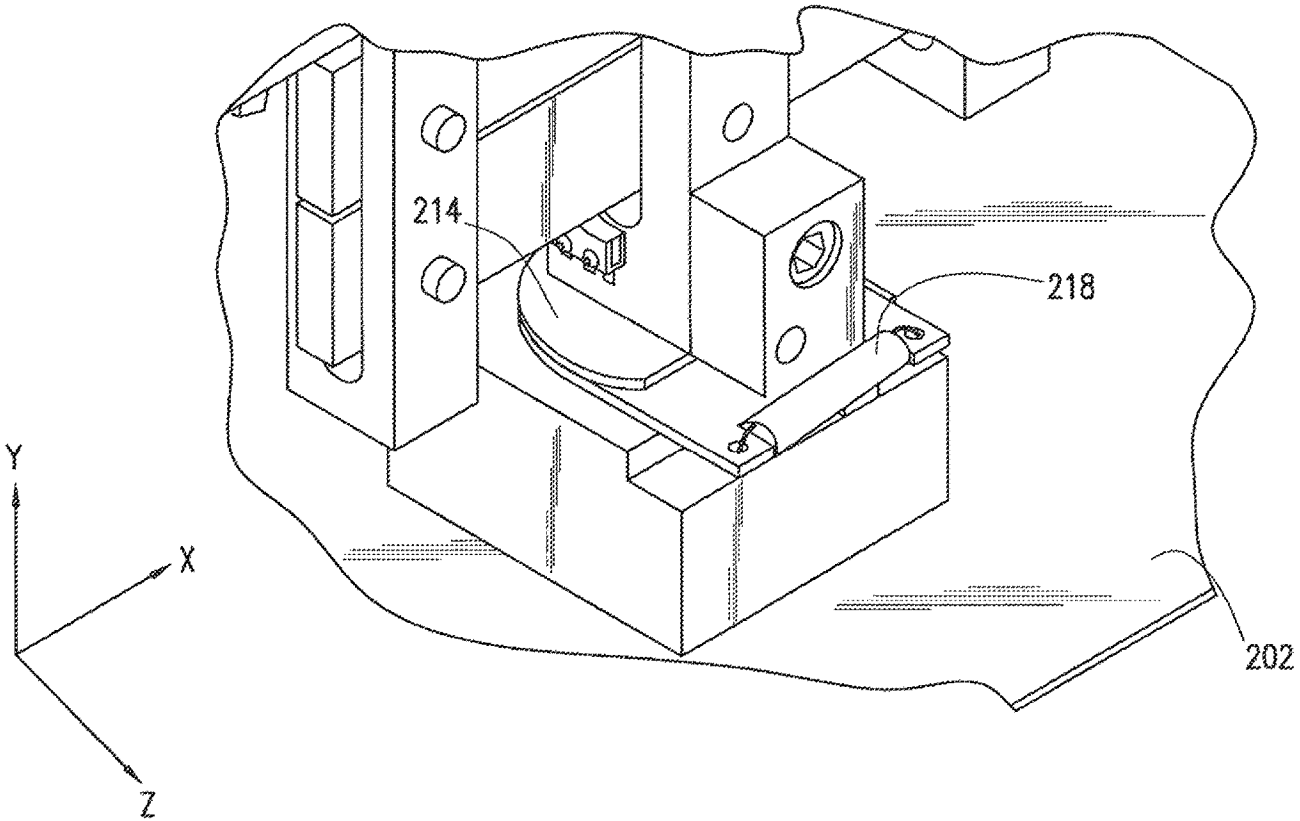
FIG. 14 shows a close-up perspective view of a centering mechanism in accordance with one or more embodiments described herein.
Figure 15:
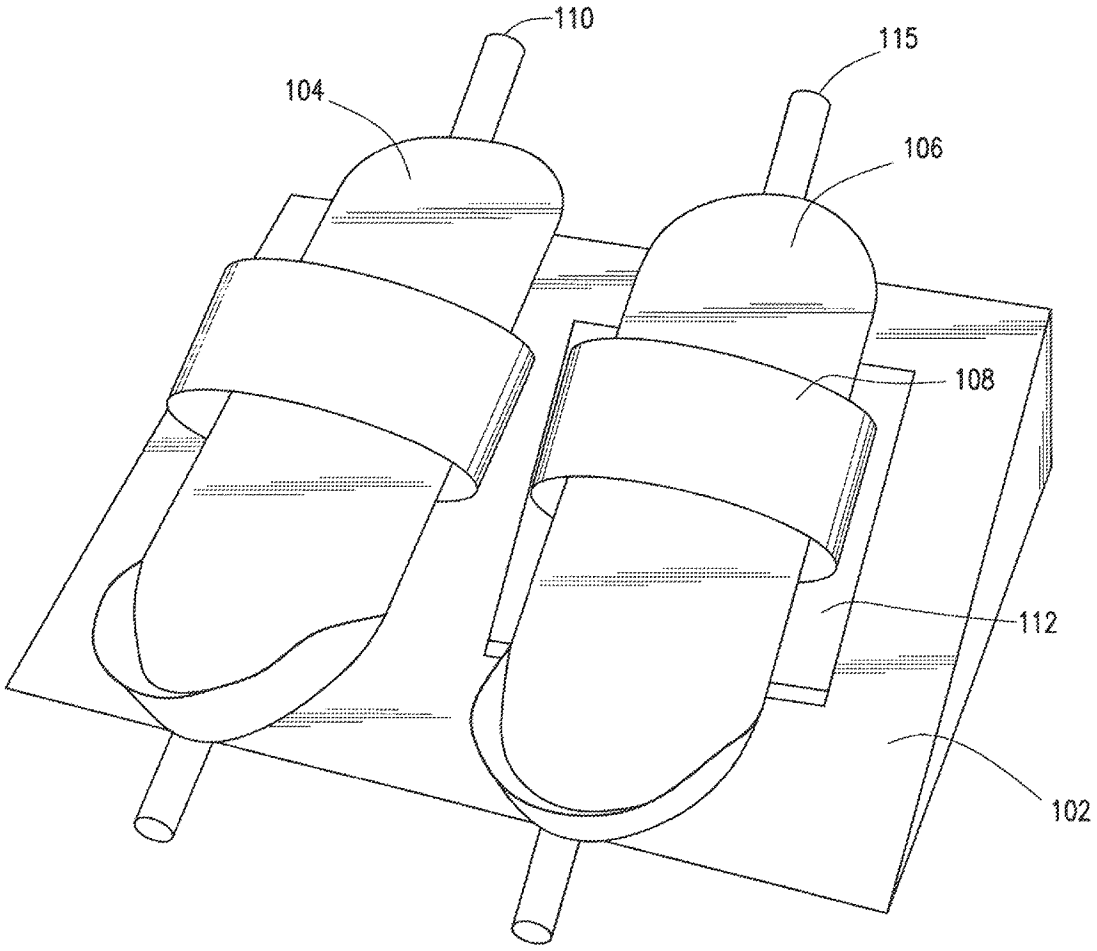
FIG. 15 shows a schematic perspective view in accordance with another embodiment described herein.

Each articulating mechanism or member may include a centering mechanism, such as, for example, a spring 218. In these embodiments, the spring force may be selected based on the strength of the operator maneuvering his or her foot. In one or more embodiments, the force associated with the centering mechanism is large enough to avoid unintended commands of motion, but low enough for comfort of the operator when directing commands of motion of the foot. An example of such a centering mechanism 218 is shown in FIG. 14, with respect to the rotation about a vertical axis (the y-axis of FIGS. 10-14) of the combined foot pivot articulating mechanism 214. For example, when the combined pedal assemblies are rotated clockwise with reference to the operator, the spring 218 is stretched by the force applied by the feet of the operator. The spring 218 then provides an opposing force to return the pedal assemblies 204 and 206 to a neutral position. Because the muscles of the foot and leg are stronger with respect to some motions than with others, springs of different spring constants (i.e., force) may be used for the different articulating mechanisms configured to enable the various different motions of the foot.

In one or more embodiments, sensors convert the pedal deflection away from a starting center location into a corresponding electrical signal. Such sensors may include, but are not limited to, a binary microswitch, a proportional position encoder, a proportional servo or drive, a strain gauge, an optical encoder, a piezo-electric sensor, or other sensors known in the art. The sensors detect motion, which may be translational and/or rotational, of the pedal assembly by measuring force, strain and/or position and transmit this sensed information, such as positional data, to a computing device.

In one or more embodiments, the set of articulating mechanisms comprise at least one rotational articulating mechanism that is configured to align with the corresponding rotational axis of the ankle of an operator so as to reduce operator discomfort and fatigue and/or to make the motion of the foot correspond more intuitively with the desired motion of the object. For example, the flexion and extension of the foot is accomplished by moving the foot about a rotational axis of an ankle of the operator, so the articulating mechanism 212 is configured to make both rotational axes (i.e., the rotational axis of the pedal and the rotational ankle of the operator) collinear. This configuration can be accomplished in one embodiment by placing the hinge line of the toe-up, toe-down articulating mechanism 212 above a tread or base of the operatively connected pedal such that it would be near the height of the ankle of the operator maneuvering the pedal in a rotational control axis. Further, in keeping with the concept of having an intuitive relationship between the motion of the foot (and the pedal that is correspondingly maneuvered) and the correspondingly resulting control instruction output by the system integrated therewith (as described herein), the flexion and extension of the foot may correspond with a set of control instructions that command the object 107 to maneuver in the rotational degree of freedom commonly referred to as pitch.

In one or more other embodiments, the set of articulating mechanisms comprise at least one rotational articulating mechanism that is configured to align with the corresponding rotational axis of the foot of an operator, again so as to reduce operator discomfort and fatigue and to make such motion of the foot in a control axis correspond with an intuitively related motion of the object 107 to be controlled. In one or more other embodiments, the set of articulating mechanisms comprise at least one rotational articulating mechanism that is configured to align with the corresponding rotational axis of the joints of the legs of an operator. For example, the inward/outward rotation of the foot as demonstrated by FIGS. 3A and 3B is accomplished by moving the foot about combined rotational axes of the ankle and hip, so the foot articulating mechanism 210 is configured to align the rotational axes of the pedal with the natural rotational axes of the joints of the operator's legs. This configuration can be accomplished in one embodiment by placing the pivot point of articulating mechanism 210 in a position below a centerline of the tread or base of the operatively connected pedal such that it is located in the proximity of where the heel of the foot of the operator would be when maneuvering the operatively connected pedal in such a rotational control axis. Further, in keeping with the concept of having an intuitive relationship between the motion of the foot (and the pedal that is correspondingly maneuvered) and the control instruction thereby output by the system integrated therewith, the inward/outward rotation of the foot (as shown in FIGS. 3A and 3B) may correspond with a set of control instructions that command the object 107 to maneuver in the rotational degree of freedom commonly referred to as yaw.

In one or more embodiments, three control axes of a first set of articulating mechanisms correspond to a first discrete set of three degrees of freedom. The motion tracking or motion sensing system comprising at least one sensor acquires data relative to the motion of the first pedal that is operatively connected to the first set of articulating mechanisms. Further, three control axes of a second set of articulating mechanisms correspond to a second discrete set of three degrees of freedom. The motion tracking or motion sensing system comprises at least one motion sensor and acquires data relative to the motion of the second pedal operatively connected to the second set of articulating mechanisms. The motion tracking or motion sensing system may measure motion of each pedal independently.

One or more embodiments of the system 100 described herein include a set of supporting electronics 101 with a CPU for receiving data (sensed information) acquired from the motion tracking or motion sensing system and with a memory storing a set of instructions for converting the data acquired into a second set of instructions for control of the object 107 in six degrees of freedom. In one or more embodiments, motion of a foot of an operator in a control axis is converted into a correspondingly intuitive movement of the object 107 in one of its six degrees of freedom of movement, as will be described in further detail below.

In one or more embodiments described herein, the range of motion in at least one of the articulation axes of the first set of articulating mechanisms and of the second set of articulating mechanisms is within the comfortable range of motion of a human operator's foot. In one or more embodiments, as mentioned earlier with respect to the implementation of a centering mechanism such as a spring, deflection forces are set low enough to be applied without strain, but high enough to minimize inadvertent control inputs. In at least one embodiment, when all the articulating mechanisms are centered, no control commands are sent and the operator's foot is disposed in a neutral, comfortable position.

In one or more embodiments, a method for pedal control of an object in six degrees of freedom includes the steps of: (a) measuring motion of a first pedal of a pedal control assembly, (b) measuring motion of a second pedal of the pedal control assembly, (c) converting the measured motion of the first pedal into a first set of data relative to a first set of three control axes, (d) converting the measured motion of the second pedal into a second set of data relative to a second set of three control axes, communicating the first set of data and the second set of a data to a computing device, and converting the first set of data and the second set of data into a second set of instructions for control of the object, wherein motion of at least one pedal by a foot of an operator in a control axis is converted into a control instruction corresponding with an intuitive movement of the object in one of the six degrees of freedom.

To operate the apparatus for pedal control, an operator places his or her feet in the pedals or custom-designed slippers. The operator moves his or her feet to deflect the pedals and send corresponding control commands to the system of an object to be controlled. Mapping of the deflection of the pedals to the motion control of the object is selected for intuitiveness and ease of control of the object such that there is minimal interference during operation between the first and second pedal movements. For example, when pushing the first pedal down an operator may instinctually raise the second pedal, or when translating the right pedal forward, an operator may instinctually translate the left pedal backward. Therefore, in one or more embodiments described herein, the mapping of the deflection of the pedals to the corresponding motion control command of the object is selected to minimize interference between the different pedal movements.

In one or more embodiments, the mapping of foot motion to a corresponding motion of an object 108 may include some or all of the following:

Left Foot
Toes down: object translation vertical down (+Z)
Toes up: object translation vertical up (−Z)
Toes left: object translation lateral port (−Y)
Toes right: object translation lateral starboard (+Y)
Foot slide forward: object: translation forward (+X)
Foot slide aft: object translation aft (−X)
Right Foot
Toes down: object pitch down (−Pitch)
Toes up: object pitch up (+Pitch)
Toes left: object yaw left (−Yaw)
Toes right: object yaw right (+Yaw)
Foot slide left: object roll left (−Roll)
Foot slide right: object roll right (+Roll).

Alternate embodiments may include articulation for different foot motions, such as lateral rolling of the foot. Alternate embodiments may also include different mapping of foot motions to object motions. For example, the above mapping may be modified such that rolling left motion is mapped to the left foot sliding left and rolling right motion is mapped to the right foot sliding right.

Further, in the above embodiments, movement of a single pedal is mapped to motion in a single degree of freedom; however, embodiments of the claimed invention are not limited as such. For example, movement of both pedals in conjunction may be mapped to motion in a single degree of freedom. In one embodiment, sliding both the left and right pedals forward and backward may be mapped to provide a set of control instructions to cause translational motion forward and aft, respectively. As another example, translating one pedal forward in conjunction with the other pedal translated backward may be mapped to provide a set of instructions for translational motion of the object port and starboard. In at least one embodiment, the mapping of pedal motion to object motion is based in part on the intuitive ease of operation to control motion of the object.

Embodiments disclosed herein may provide for control over an object with six degrees of freedom of movement using only the operator's feet, thereby making the hands available for other tasks. Embodiments disclosed herein have applications in robotics, such as drones, battlefield robots, and oilfield rovers, as well as in applications for video games and/or underwater submersibles. Embodiments disclosed herein may also help facilitate movement for individuals with upper body disabilities. Further, embodiments disclosed herein may provide a means for piloting a spacecraft without the need of traditional flight training.

Furthermore, it should be understood by those having ordinary skill in the pertinent art that the present disclosure shall not be limited to specific examples depicted in the drawings and described in the specification. While the present disclosure has been described with respect to a limited number of embodiments, those skilled in the art, having benefit of this disclosure, will readily appreciate that other embodiments may be devised which do not depart from the scope of the disclosure as described herein. Accordingly, all such modifications are intended to be included within the scope of the disclosure described herein and defined in the following claims. In the claims, means-plus-function and step-plus-function clauses are intended to cover the acts and/or structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Accordingly, the scope of the invention should be limited only by the attached claims.

What is claimed is:

1. An apparatus to control motion in six degrees of freedom, comprising:

a support;

a first pedal;

a second pedal;

a first set of three independent articulating mechanisms operatively connected to the first pedal and the support, each independent articulating mechanism of the first set configured to enable motion of the first pedal in a discrete motion axis corresponding to only one of three translational degrees of freedom and three rotational degrees of freedom, wherein one of the independent articulating mechanisms of the first set includes a hinge positioned above the first pedal to enable discrete rotation of the first pedal about an axis collinear with the rotational axis for flexion and extension of an ankle of a human operator, the first set of three independent articulating mechanisms, in combination, configured to enable motion of the first pedal in three discrete motion axes; and a second set of three independent articulating mechanisms operatively connected to the second pedal, each independent articulating mechanism of the second set configured to enable motion of the second pedal in a discrete motion axis corresponding to only one of three translational degrees of freedom and three rotational degrees of freedom, the second set of three independent articulating mechanisms, in combination, configured to enable motion of the second pedal in three discrete motion axes.

2. The apparatus of claim 1, wherein at least one of the independent articulating mechanisms of the first set is configured to enable discrete motion of the first pedal in an axis corresponding to forward and backward in-plane translation.

3. The apparatus of claim 1, wherein at least one of the independent articulating mechanisms of the first set is configured to enable discrete motion of the first pedal in an axis corresponding to lateral in-plane translation to the left and right of a human operator.

4. The apparatus of claim 1, wherein at least one of the independent articulating mechanisms of the first set is configured to enable discrete motion in an axis corresponding to moving the first pedal up and down vertically.

5. The apparatus of claim 1, wherein at least one of the independent articulating mechanisms of the second set is configured to enable discrete rotation of the second pedal about an axis collinear with the rotational axis for flexion and extension of an ankle of a human operator.

6. The apparatus of claim 1, wherein at least one of the independent articulating mechanisms of the second set is configured to enable discrete rotation of the second pedal about a horizontal axis corresponding to lateral rolling of an ankle of a human operator.

7. The apparatus of claim 1, wherein at least one of the independent articulating mechanisms of the first set includes a centering mechanism for specifying a neutral position of the first pedal.

8. The apparatus of claim 7, wherein at least one of the independent articulating mechanisms of the second set includes a centering mechanism for specifying a neutral position of the second pedal.

9. The apparatus of claim 8, wherein the centering mechanism for specifying a neutral position is spring-driven, and a deflection force necessary for moving the first pedal and the second pedal is determined by the spring-driven centering mechanism.

10. The apparatus of claim 1, wherein one of the independent articulating mechanisms of the first set is configured to enable motion in a rotational control axis that corresponds with a rotational axis of a joint of a leg of a human operator.

11. The apparatus of claim 1, further comprising:

a first sensor configured to detect the motion of the first pedal in at least one of three degrees of freedom; and a second sensor configured to detect the motion of the second pedal in at least one of three degrees of freedom.

12. A system to control motion of an object in six degrees of freedom, comprising:

(a) a housing;

(b) a pedal assembly operatively connected to the housing, the pedal assembly comprising:

a support;

a first pedal;

a second pedal;

a first set of three independent articulating mechanisms operatively connected to the first pedal and to the support, each independent articulating mechanism of the first set configured to enable motion of the first pedal in a discrete motion axis corresponding to only one of three translational degrees of freedom and three rotational degrees of freedom, wherein one of the independent articulating mechanisms of the first set includes a hinge positioned above the first pedal to enable discrete rotation of the first pedal about an axis collinear with the rotational axis for flexion and extension of an ankle of a human operator, the first set of three independent articulating mechanisms, in combination, configured to enable motion of the first pedal in three discrete motion axes; and a second set of three independent articulating mechanisms operatively connected to the second pedal and to the support, each independent articulating mechanism of the second set configured to enable motion of the second pedal in a discrete motion axis corresponding to only one of three translational degrees of freedom and three rotational degrees of freedom, the second set of three independent articulating mechanisms, in combination, configured to enable motion of the second pedal in three discrete motion axes;

(c) a motion tracking system for acquiring data responsive to the motion of the first pedal and to motion of the second pedal by measuring motion of each pedal independently from a neutral centering position; and (d) a subsystem of electronics for receiving data acquired by the motion tracking system, the subsystem of electronics including a central processing unit and a memory for storing instructions that, when executed, cause the subsystem to convert the data acquired by the motion tracking system into a second set of instructions for control of the object.

* * * * *